US011639652B2

(12) United States Patent
Wock et al.

(10) Patent No.: US 11,639,652 B2
(45) Date of Patent: May 2, 2023

(54) SYSTEM AND METHOD FOR MONITORING AND ADJUSTMENT OF THE WELL STRING WITHIN A WELL TUBULAR

(71) Applicants: Cary Wock, Estevan (CA); Jared Schlamp, Estevan (CA)

(72) Inventors: Cary Wock, Estevan (CA); Jared Schlamp, Estevan (CA)

( * ) Notice: Subject to any disclaimer, the term of this patent is extended or adjusted under 35 U.S.C. 154(b) by 0 days.

(21) Appl. No.: 17/208,922

(22) Filed: Mar. 22, 2021

(65) Prior Publication Data

US 2021/0207461 A1 Jul. 8, 2021

Related U.S. Application Data

(63) Continuation-in-part of application No. 16/136,376, filed on Sep. 20, 2018, now abandoned.

(51) Int. Cl.
*E21B 47/009* (2012.01)
*E21B 43/12* (2006.01)
*E21B 34/06* (2006.01)

(52) U.S. Cl.
CPC ..... *E21B 43/127* (2013.01); *E21B 34/06* (2013.01); *E21B 47/009* (2020.05)

(58) Field of Classification Search
CPC .... E21B 47/009; E21B 43/127; E21B 43/126; E21B 47/0008; E21B 2043/125; Y10T 74/18182; F04B 47/026
See application file for complete search history.

(56) References Cited

U.S. PATENT DOCUMENTS

| | | | | |
|---|---|---|---|---|
| 1,713,219 | A * | 5/1929 | Eisenhauer | F04B 47/02 417/415 |
| 2,114,090 | A * | 4/1938 | Stone | F04B 53/144 403/81 |
| 8,082,734 | B2 * | 12/2011 | St. Denis | F04B 9/02 60/369 |
| 10,508,522 | B2 * | 12/2019 | Johnson | E21B 47/009 |
| 2010/0037716 | A1 * | 2/2010 | Rolan | F04B 47/026 74/41 |
| 2013/0181844 | A1 * | 7/2013 | Hurst | E21B 43/127 340/854.6 |
| 2017/0211365 | A1 * | 7/2017 | Johnson | E21B 41/0092 |
| 2018/0112475 | A1 * | 4/2018 | Scekic | F04B 47/026 |
| 2020/0182028 | A1 * | 6/2020 | Ewing | E21B 47/009 |

* cited by examiner

*Primary Examiner* — Kipp C Wallace
(74) *Attorney, Agent, or Firm* — Christensen Fonder Dardi; Douglas Christensen

(57) ABSTRACT

A powered well string positioner capable of actuation during the vertical reciprocal movement of a well string will increase or decrease the length of the downhole well string length below the wellhead seal upon detection of a string positioning condition within the tubular by a controller. The vertical reciprocal stroke of the power unit of the well is not changed as the downhole length of the well string is varied, and the well string can be adjusted during operation of the well without the need to disassemble the well string.

14 Claims, 6 Drawing Sheets

SYSTEM AND METHOD FOR MONITORING AND ADJUSTMENT OF THE WELL STRING WITHIN A WELL TUBULAR

CROSS REFERENCE TO RELATED APPLICATIONS

This application is a continuation-in-part of U.S. patent application Ser. No. 16/136,376, filed Sep. 20, 2018, the disclosures of which are hereby incorporated by reference herein in their entireties.

FIELD OF THE INVENTION

This invention is in the field of oil-bearing formation drilling and more specifically in the field of downhole plunger-style pumps and controls to allow for automated optimized operation of oil extraction pumps and apparatus.

BACKGROUND

Extraction of oil from hydrocarbon-bearing geological formations is a complicated and capital-intensive process. Typically, once a well is drilled into an oil-bearing formation, the drilling string is extracted and a tubular or casing finalized in place in the well, through which pumping or extraction tools can be used to extract oil up the well tubular to the wellhead for transport or further processing.

In many cases, where a well is drilled substantially vertically down into the formation, vertical reciprocal pumps and "pump jacks" are used to bring extracted oil to surface. A typical arrangement of this nature comprises a downhole plunger style pump attached at the distal end of the well string, within the tubular at a pumping location at which perforations in tubular or other means allow for entry of oil from the formation into the tubular and for pumping to the surface of the tubular upon vertical reciprocating motion of the well string and operation of the pump.

Sometimes in optimizing the operating parameters of the pumping system, or to avoid the tapping of the travelling valve on the bottom of the well, it is desirable to shorten or lengthen the downhole well string length downhole well string length, below the wellhead seal. For the sake of discussion throughout this specification, the downhole well string length refers to the length of the well string below the wellhead seal, extending downward in the tubular to a distal lower end. Traditionally one way this has been done is to disassemble the well string and either shorten or lengthen it, to result in adjustment of the downhole well string length. This type of an approach requires shutdown of the well equipment during adjustment however, so pumping is interrupted, and the need to disassemble much of the equipment at the wellhead to achieve this type of a well string adjustment is also unduly complicated and carries safety and operational risks. If it were possible to come up with a method for the adjustment of the well string length within an oil well tubular without the need to shorten or lengthen the well string as a whole is believed that this would be commercially desirable and accepted.

Another approach which is often used is to shorten or lengthen the stroke of the vertical reciprocating power unit which is used to actuate the well string and the travelling valve assembly of the pump. However, shortening or lengthening the stroke of the vertical reciprocating power unit has a significant effect on the efficiency of the pumping equipment and the pumping yield at the wellhead—if the stroke is shortened, less oil is pumped with each stroke, and if the stroke is lengthened while the pumping volume is potentially increased, there are operational parameter applications to the added weight or volume of oil within the tubular, or otherwise. If it were possible to come up with a method of adjusting the downhole well string length without the need to shorten or lengthen the stroke of the vertical reciprocating power unit used, it is believed again this would be a significant commercial benefit and would be widely commercially accepted in the industry.

Any type of an approach to adjusting the downhole well string length without the need to shut down pumping or oil production would be desirable in order to maintain consistent output from the pump and the well and maximize commercial success. If it was possible to do this while maintaining constant stroke length of the vertical pumping apparatus, optimized operation could be insured.

Another previous limitation has been that monitoring the need to adjust the downhole well string length has been a human or manual process. Pump system operators wishing to optimize the operation of a particular pumping system might manually decide to adjust the downhole well string length, or they might determine based upon the existence of tapping or other detected problems with the operation of the pump that there was a need to adjust the downhole well string length and thus a manual adjustment could be made. If it were possible to monitor the performance of an oil well to detect the existence of a condition in which an adjustment to the downhole well string length would be desirable, in accordance with the remainder of the present invention, and automatically make the adjustment without the need for operator intervention, it is also felt that this would be a further desirable approach which would be widely commercially accepted.

SUMMARY OF THE INVENTION

As outlined above it is the object of the present invention to provide a system and method for the automatic adjustment of the downhole well string length within an oil well tubular, upon the detection of a condition requiring the adjustment of the downhole well string length.

It is the further object of the present invention to provide a system and method for the automatic adjustment of the downhole well string length in which the downhole well string length could be adjusted without the need to stop operation of the pump.

It is the further object of the present invention to provide a system and method for the automatic adjustment of the downhole well string length in which the downhole well string length could be adjusted without the need to disassemble the well string and adjust its length in any way.

It is the further object of the present invention to provide a system and method for the automatic adjustment of downhole well string length within an oil well tubular in which the stroke of the vertical reciprocal power unit used to actuate the travelling valve assembly of a typical downhole plunger-style pump would not need to be adjusted in any way while the well string was adjusted.

There are thousands of pre-existing vertical reciprocating oil pumps in operation in oil fields around the world and if it were possible to come up with a retrofit equipment modification to implement a method and approach the present invention namely the ability to adjust the downhole well string length while the pump is in operation, and without the need to disassemble the well string or to alter the stroke of the vertical power unit, such an aftermarket modification would be widely deployable, so such an invention would have aftermarket or service market utility in addition to potential as an OEM feature.

In a first embodiment of the invention, these objectives are achieved by a method of automatic adjustment of the downhole well string length in a subterranean oil well comprising a well tubular extending downwards from a wellhead at the earth surface to the bottom of the well in a subterranean fluid-producing formation; a well string having a lower end and a top end and extending downward through a seal on the wellhead inside the well tubular (the length of the well string from below the wellhead seal to the lower end being the downhole well string length); and a downhole plunger-style pump located within the tubular attached to the lower end of the well string. Upon application of vertical reciprocating movement to the well string, the plunger and a travelling valve assembly will pump oil from the formation up the well tubular to the wellhead. A vertical reciprocating power unit is attached to the well string which can apply vertical reciprocating motion of the desired stroke length for the plunger to the well string.

The method uses a powered well string positioner connecting the top end of the well string to the reciprocating power unit and which rotatably engages the well string such that the well string can be rotated along its axis within the tubular during operation of the vertical reciprocating power unit while being vertically retained in a position defining the downhole well string length; and wherein upon actuation the well string positioner will raise or lower the top end of the well string above the well string positioner resulting in the decrease or increase of the downhole well string length.

A controller capable of monitoring at least one well condition sensor to determine the existence of a string positioning condition within the tubular is also included—the controller will actuate the well string positioner to modify the downhole well string length on detection of a string positioning condition, until the string positioning condition is eliminated.

During the operation of the vertical reciprocating power unit, the controller will monitor the at least one well condition sensor to detect the existence of a string positioning condition within the tubular. A string positioning condition could either be a desire from the operator to manually trigger an adjustment to downhole well string length, or the at least one well condition sensor could determine that the positioning of the pump in the in the tubular needed to be adjusted to optimize its performance or avoid negative equipment impact by adjusting downhole well string length.

Upon detection of a string positioning condition, the controller will actuate the well string positioner to modify the downhole well string length until the string positioning condition is eliminated. The well string positioner will modify the downhole well string length while the vertical reciprocating power unit continues operation without the need to disassemble the well string, and the stroke of the vertical reciprocating power unit does not change when the downhole well string length is changed in accordance with this method.

In many embodiments of the anticipated system and method of the present invention, the top end of the well string is threaded and the well string positioner could include a threaded mount for cooperatively engaging the threaded top end of the well string, permitting the well string to be rotated axially along its length within the mount upon application of rotational motion thereto and upon which rotation the threaded top end will move upwards or downwards through the mount. A bidirectional rotary power source would be mounted to on actuation apply rotational motion to the threaded top end of the well string rotary power source engaging a threaded top end of the well string, which can by rotation and engagement with the threaded end effectively shorten or lengthen, dependent upon the direction of rotation, the well string between the vertical reciprocating power unit and the pump—basically increasing the downhole well string length by lowering the threaded top end of the well string down from the well string positioner, and or conversely decreasing the downhole well string length by raising the threaded top end of the well string through the well string positioner.

The well string positioner could also comprise a carrier bar with a bar aperture therethrough through which the threaded portion of the top end of the well string extends, said carrier bar being attached to the reciprocating movement.

The rotary power means used in the embodiments of the system, controller and method of the present invention could comprise hydraulic or electric motors. Any type of a rotary power means will be understood to be within the scope of the present invention in so far as they could be powered or actuated during operation of the vertical reciprocating power unit.

The well string positioner could also be used to periodically incrementally rotate the well string along its axis, to provide periodic well string rotation within the tubular and the controller could periodically and incrementally rotate the well string in such embodiments.

There are many different types of string positioning conditions which it might be desired to detect for use as a trigger parameter within the method of the present invention. Two specific string positioning conditions which are contemplated are where a travelling valve assembly is determined to not be optimally positioned in the downhole plunger-style pump, such that the downhole well string length needs to be increased or decreased, or upon a manual control input from operators who wish to manually adjust the well string to optimize the performance of the pump. Any number of different types of additional string positioning conditions or parameters contributing to the detection of a string positioning condition could also be considered and any type of a string positioning condition which upon its detection would result in the desire to adjust by increasing or decreasing the well string with an oil well will be understood to be within the scope of the present invention.

The at least one well string condition sensor used to detect the existence of a string positioning condition could be a sensor used to downhole or in the formation, or could also be a sensor that was somehow attached or capable of capturing relevant data readings above ground in respect of the well string or as downhole operations and optimal productivity of the well. Any type of a sensor or sensors which could detect the existence of the need for an adjustment of downhole well string length, being a string positioning condition, are all contemplated within the scope of the present invention.

Where manual actuation of the well string changes is desired, at least one well condition sensor might be a human interface device allowing for an operator to select or trigger a well string change.

It is primarily contemplated that the vertical reciprocating power unit of the present invention is a conventional oilfield pump jack although any other type of a vertical reciprocal power unit capable of actuation of the downhole plunger style pump such as is otherwise outlined herein is contemplated to be within the scope of the present invention.

One of the key elements of the method of the present invention which renders it novel and desirable over the current state-of-the-art is the fact that the controller and well string positioner of the present invention can work together in an automatic mode to allow for automated unsupervised adjustment of the well string—this will allow for continual optimized operation of an oil pump in a well application, without the need for significant ongoing or continual human operator oversight. As well, the well string positioner of the present invention working in conjunction with the controller will allow for adjustment of the well string within the tubular without the need to shut down the pump or to disassemble well string, and the stroke of the vertical reciprocating power unit need not be adjusted or changed in the scope of the remainder of the operation.

In addition to the method of the present invention there is disclosed a system for use in the automatic adjustment of downhole well string length, the well string having a lower end and a top end (the length of the well string from below the wellhead seal to the lower end being the downhole well string length); and a downhole plunger-style pump located within the tubular. Upon application of vertical reciprocating movement to the well string, a travelling valve assembly in the pump will pump oil from the formation up the well tubular to the wellhead. A vertical reciprocating power unit is attached to the well string which can apply vertical reciprocating motion of a desired stroke length for the plunger to the well string.

The system comprises two key components—a well string positioner connecting the top end of the well string to the reciprocating power unit and capable of actuation while the reciprocating power unit is in operation; and a controller capable of monitoring at least one well condition sensor to determine the existence of a string positioning condition within the tubular and of actuating the well string positioner to modify the downhole well string length. The system of the present invention, namely the well string positioner and the operatively connected controller and at least one well condition sensor as outlined, can be used to practice the method of the present invention namely to adjust the well string within an oil well tubular during vertical reciprocating operation of the pump in the oil well, and without the need to adjust the stroke of the vertical reciprocating power unit.

During operation of the vertical reciprocating power unit, the controller will monitor the at least one well condition sensor to detect the existence of a string positioning condition within the tubular; and upon detection of a string positioning condition within the tubular, actuate the well string positioner to modify the downhole well string length to eliminate the string positioning condition. The downhole well string length can be adjusted during operation of the vertical reciprocating power unit without the need to disassemble the well string, and the stroke of the reciprocal movement does not change when the downhole well string length is changed. Many variations on the well string positioner and the controller or sensors of the present invention will be understood to those skilled in the art based upon the general scope of the invention outlined elsewhere in this document and any such modifications and permutations of the invention are contemplated within the scope of the present invention.

The top end of the well string of the well might be threaded, and the well string positioner could include a threaded mount for cooperatively engaging the threaded top end of the well string, permitting the well string to be rotated axially along its length within the mount upon application of rotational motion thereto and upon which rotation the threaded top end will move upwards or downwards through the mount. A bidirectional rotary power source would be mounted to on actuation apply rotational motion to the threaded top end of the well string rotary power source engaging a threaded top end of the well string, which can by rotation and engagement with the threaded end effectively shorten or lengthen, dependent upon the direction of rotation, the well string between the vertical reciprocating power unit and the pump—basically increasing the downhole well string length by lowering the threaded top end of the well string down from the well string positioner, and or conversely decreasing the downhole well string length by raising the threaded top end of the well string through the well string positioner. The well string positioner could also comprise a carrier bar with a bar aperture therethrough through which the threaded portion of the top end of the well string extends, said carrier bar being attached to the reciprocating movement.

The controller could also periodically activate the well string positioner for the purpose of applying incremental rotation to the well string along its length down the tubular.

Another embodiment of the present invention is a controller for use in the automatic adjustment of downhole well string length where the well comprises a well tubular extending downwards from a wellhead at the earth surface to the bottom of the well in a subterranean fluid-producing formation; a well string having a lower end and a top end; and a downhole plunger-style pump located within the tubular. Upon application of vertical reciprocating movement to the well string, a travelling valve assembly in the pump will pump oil from the formation of the well tubular to the wellhead. A vertical reciprocating power unit is attached to the well string which can apply vertical reciprocating motion of a desired stroke length for the plunger to the well string.

The oil well and pump would also be fitted with a well string positioner connecting the top end of the well string to the reciprocating power unit and capable of actuation while the reciprocating power unit is in operation, whereby on actuation of the well string positioner the top end of the well string can be moved up or down through the seal on the wellhead, resulting in the raising or lowering of the well string below the well string positioner and the decrease or increase of the downhole well string length. The well would also comprise at least one well condition sensor to determine the existence of a string positioning condition within the tubular.

The controller itself comprises an electronic controller capable of monitoring at least one well condition sensor to determine the existence of a string positioning condition within the tubular, and of actuating the well string positioner to modify the downhole well string length; whereby during operation of the vertical reciprocating power unit, the controller will monitor the at least one well condition sensor to detect the existence of a string positioning condition within the tubular; and upon detection of a string positioning condition within the tubular, actuate the well string positioner to modify the downhole well string length to eliminate the string positioning condition. The controller could comprise a controller specifically manufactured to actuate and control a well string positioner in accordance with the remainder of the present invention, or any other type of a well string positioner to which it was desired to apply the automated monitoring and adjustment methodology of the present invention.

It will be understood that there are many variations on the method, system and controller of the present invention as will be obvious to those skilled in the art of oilfield production and control and instrumentation design and any such modifications and variations are intended to be within the scope of the present invention as claimed and outlined herein.

DESCRIPTION OF THE DRAWINGS

To easily identify the discussion of any element or act, the most significant digit or digits in a reference number refer to the figure number in which that element is first introduced. The drawings enclosed are.

DETAILED DESCRIPTION OF ILLUSTRATED EMBODIMENTS

Figure 1:
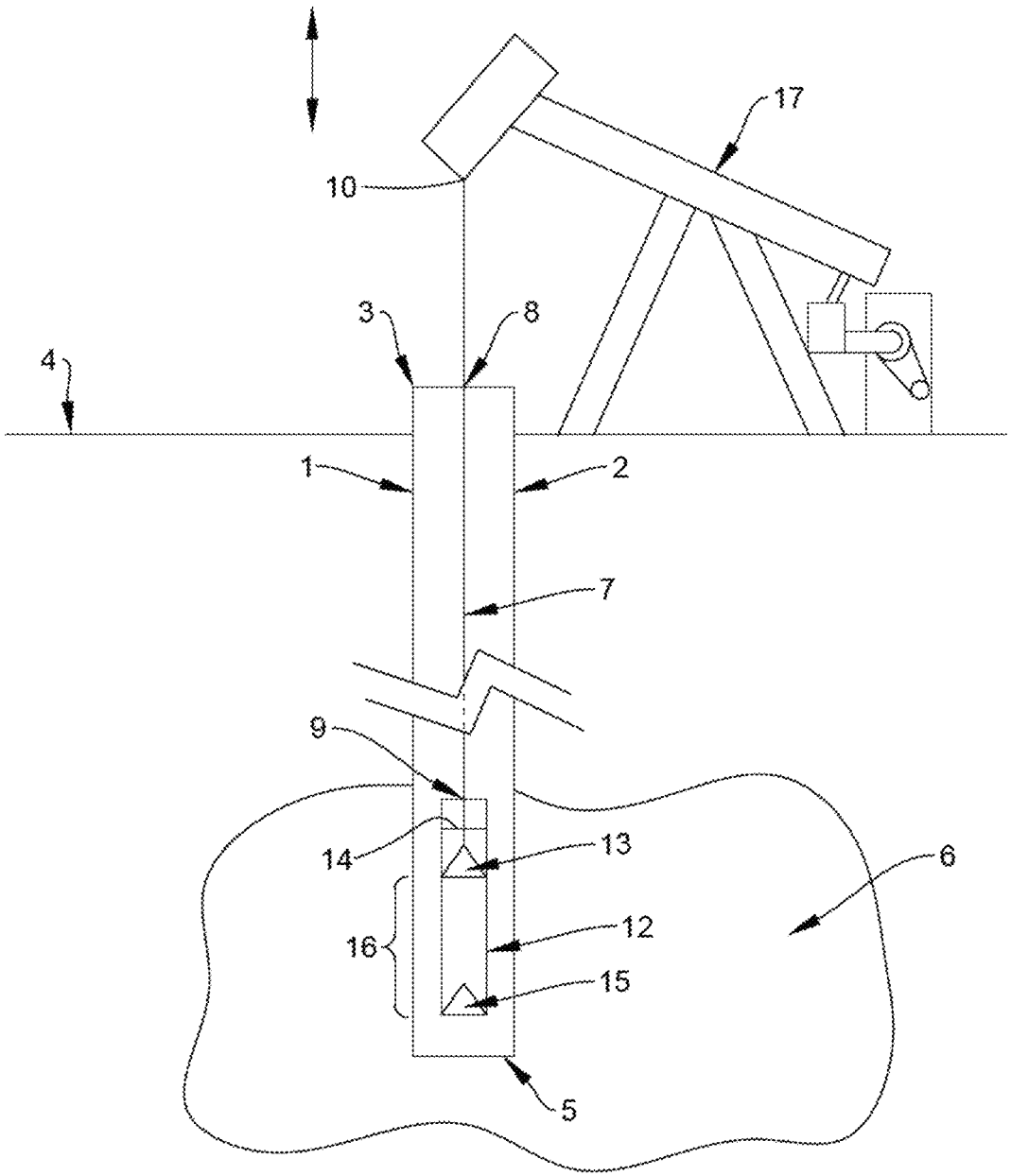
FIG. 1 is a schematic drawing of a typical oil well and pumping configuration, for the purpose of demonstrating the interrelation of components in prior art or other installations.

The schematic drawing of FIG. 1 shows the key components of an oil well, for the purpose of demonstration of the various components contemplated within the present invention. The typical well 1 comprises a well tubular 2 extending downwards from a wellhead 3 at the earth surface 4 to the bottom 5 of the well 1 in a subterranean fluid-producing formation 6. The tubular 2 is either open or perforated near its bottom end or at locations therealong where it is desired to facilitate the entry of oil into the tubular from the formation. Inside the tubular 2 is a well string 7 having a top end 10 and extending downwards through a wellhead seal 8 to a lower end 9. The lower end 9 of the well string 7 would typically be at a location within the tubular 2 that was the lowest potential location at which it was desired to position the pump 12. A downhole plunger-style pump 12 is located within the tubular.

A vertical reciprocating power unit 17 is attached to the well string 7 which can apply vertical reciprocating motion of a desired stroke length for the plunger 13 to the well string 7. Upon application of vertical reciprocating movement to the well string 7, a travelling valve assembly 14 of the pump 12 will pump oil from the formation up the well tubular 2 to the wellhead 3. Typical vertical reciprocating power units 17 used with this oil well extraction apparatus is known as pump jacks. The vertical reciprocating power unit 17 shown in FIG. 1 is a conventional pump jack.

The wellhead 3 is equipped with offtake conduits and/or pumping equipment (not shown) capable of evacuating the extracted oil from the tubular/wellhead into storage or a pipeline.

Figure 2:
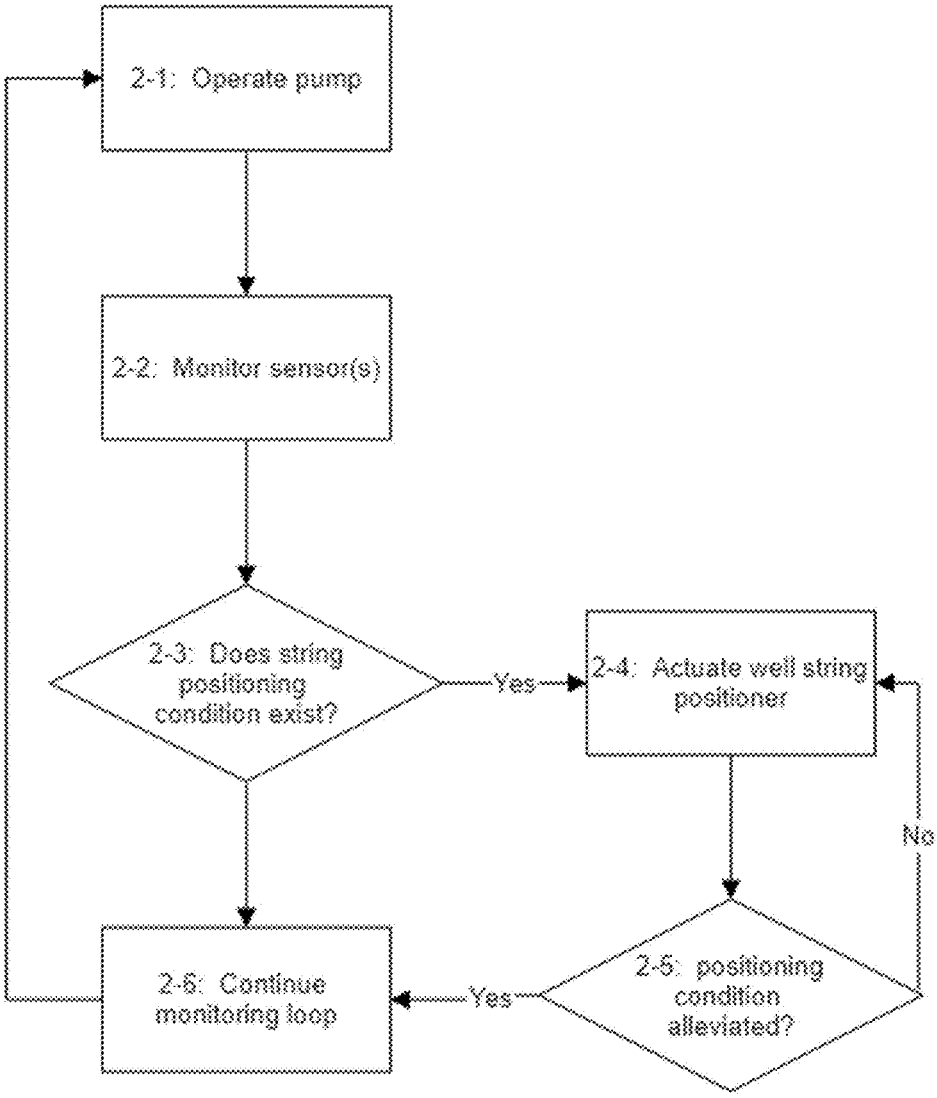
FIG. 2 is a flow chart demonstrating the steps in one embodiment of the well string adjustment method of the present invention.

FIG. 2 is a flowchart demonstrating the steps of one embodiment of a method in accordance with the present invention. The method of automated adjustment of the downhole well string length comprises, using a well string positioner and a related controller connected to at least one well condition sensor in relation to the well, sensing the existence of a well string positioning condition and actuating the well string positioner by the controller to alleviate or remove the well string positioning condition. The first step which is shown in this Figure is the actual operation of the well, shown at 2-1. The operation of the well, referring to the general embodiment shown in FIG. 1, would comprise operation of the vertical reciprocating power unit 17 which results in the application of vertical reciprocating pumping motion to the well string 7 and the pumping of oil.

During operation of the vertical reciprocating power unit 17, the at least one well condition sensor will be monitored by a controller to detect the existence of a string positioning condition. The monitoring step is shown at 2-2. A detection decision step within the monitoring loop is shown at 2-3, wherein if a string positioning condition is determined to exist, the well string positioner operatively connected to the controller would be actuated, at step 2-4, to alter the downhole well string length until the well string condition was alleviated or eliminated—the determination of the completion of the well string adjustment is shown at step 2-5. Following the adjustment of the downhole well string length within the tubular in response to the detection of a string positioning condition, or in continuing the monitoring loop where no string positioning condition is determined to exist (2-6) the pump would continue to operate, and the controller would continue to monitor for the existence of string positioning conditions and would adjust the downhole well string length within the tubular on detection of any such condition as required. By operating the controller and related at least one sensor during operation of the pump, the method of this Figure will allow for automated well string adjustment in the related oil well. As outlined elsewhere above, one of the well string adjustment conditions which could be detected would actually be a selection by an operator of a manual control input to allow for manual well string adjustment, in addition to the determination or detection of trigger parameters within our in relation to the well which would result in an automatic string positioning condition.

Figure 3:
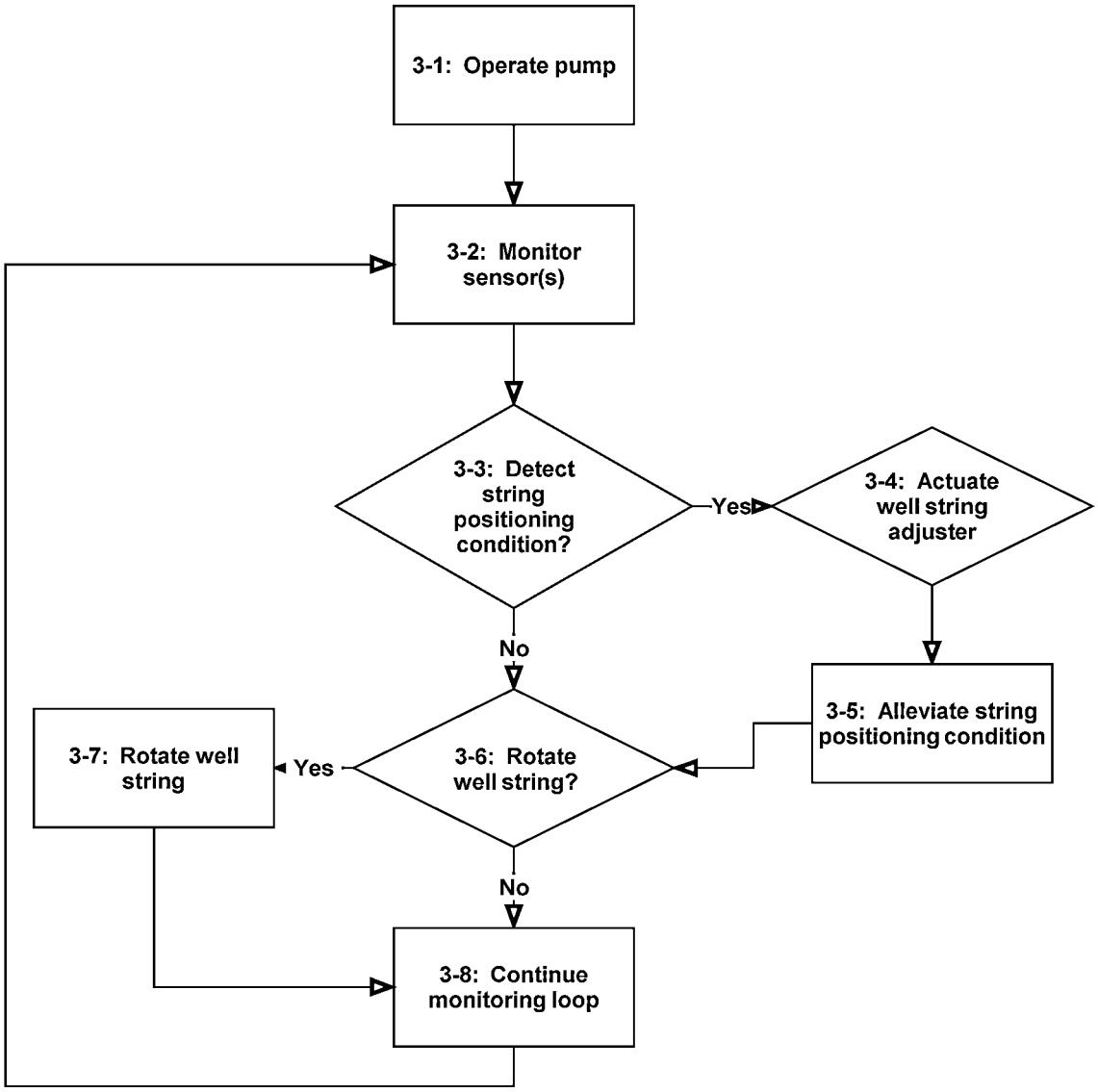
FIG. 3 is a flowchart demonstrating the steps in an alternate embodiment of the method of the present invention in which the well string will also be rotated periodically by the well string positioner.

FIG. 3 shows a flowchart of an alternate embodiment of the method of the present invention, similar to that of FIG. 2 except that a periodic well string rotation step is shown at 3-5 and 3-6—in embodiments such as this the controller might be programmed to detect the existence of either of periodic frequency or some other type of a rotational condition requiring incremental well string rotation within the tubular—a decision block in this regard is shown at 3-6. Where it was determined that an incremental well string rotation should be applied, the well string positioner could be actuated, shown at 3-7, to apply such an incremental rotation. The monitoring loop would then continue, as shown at 3-8.

Figure 4:
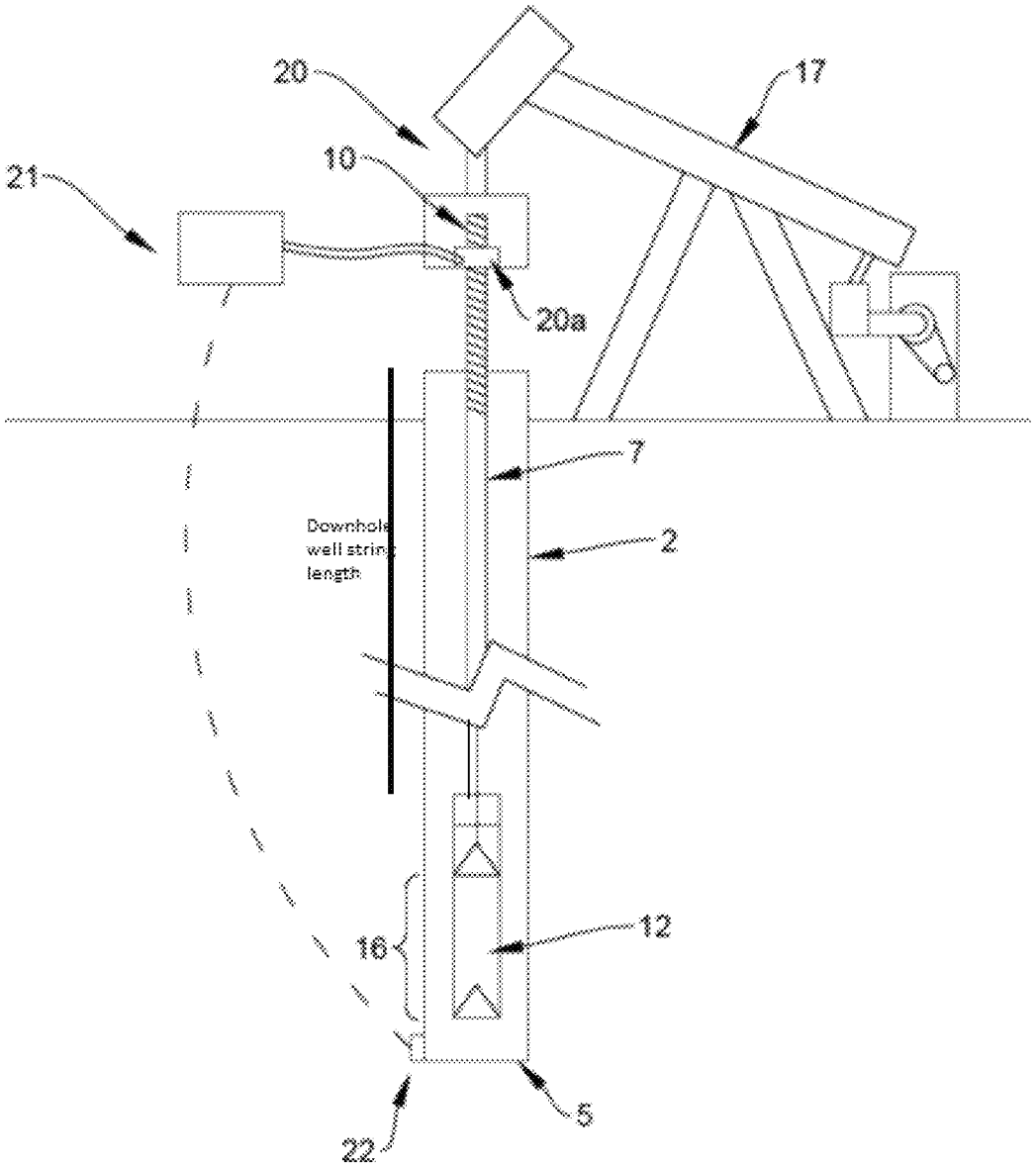
FIG. 4 is a schematic drawing of one embodiment of the system of the present invention.

System Overview:

FIG. 4 is a schematic diagram of the elements of one system in accordance with the method of the present invention for the automatic adjustment of the downhole well string length. The oil well itself is shown, with the key components thereof labelled similar to those of the earlier oil well demonstrated in FIG. 1.

The well tubular 2 is shown with the well string 7 extending downward therethrough. The vertical reciprocating power unit 17 is shown attached to the top end 10 of the well string 7. The top end 10 is attached to the vertical reciprocating power unit 17 via a well string positioner 20. In the case shown, the well string positioner 20 comprises a rotary power unit 20A which comprises a cooperating threaded mount which engages a threaded upper portion of the well string 7 which when actuated will allow for the expansion or contraction of the well string without any change in the stroke of the vertical reciprocating power unit 17. Well string positioner 20 is attached to the controller 21 and the controller 21 can actuate the rotary power unit 20A as required to increase or decrease the well string in the oil well as desired. One downhole well condition sensor 22 is shown which is also connected to the controller 21.

Well String Positioner

As discussed throughout, a key component of the system of the present invention is a well string positioner 20 which is operatively connected to the well string 7 and the vertical reciprocating power unit 17 which will allow for shortening or lengthening the length of the well string 7 below the well string positioner 20, resulting in the adjustment of the well string 7 without changing the stroke of the vertical reciprocating power unit 17. FIG. 3 demonstrates a sample of a rotary well string positioner 20 in accordance with the invention.

Either a rotary powered or linear actuated well string positioner 20, connected to the controller 21 such that it could be activated to allow for the shortening or lengthening of the well string 7 below the wellhead seal 8 as required, is contemplated within the scope of the present invention. In the case of a rotary powered well string positioner 20, the typical method of attachment of the rotary powered well string positioner 20 might comprise a yoke 23 and carrier bar 22 attachment system which is attachable to the pump jack 17 and has a bar aperture 22A extending therethrough. In addition to being attached to the reciprocating movement 17, the carrier bar 22 system could have the rotary power source 20A—attached to the top of the carrier bar 22 above the bar aperture 22A so that the threaded upper portion 7A of the well string 7 is engaged by the rotary power source 20A after passing through the bar aperture 22A. This would allow for the rotary power means 20A when turned on to raise or lower the well string 7 and result in an attendant adjustment of the length of the well string below the wellhead seal 8. Effectively, rotary movement of the motor 20A would be translated into a raising or lowering motion applied to the well string 7. The cooperative threaded engagement of the top end 7A of the well string 7, permitting the well string 7 to be rotated axially along its length within the mount/motor etc. upon application of rotational motion thereto, and upon which rotation the threaded top end of the well string 7 will move upwards or downwards through the mount and the well string positioner, resulting in either the decrease or increase of downhole well string length.

It will be understood to those skilled in the art of mechanical system design that in some cases it may be desired to create a means of attachment between a threaded upper portion of the well string and rotary power means that would result in the rotation of the well string when it was lifted or lowered, and other modified approaches could be taken in which the threaded engagement of the two systems would simply result in the lifting or lowering of the well string within the tubular without a rotary motion being applied to string. In some embodiments, the rotational power of the rotary power means 20A could be translated directly onto the threaded upper portion of the well string 7 whereby rotations of the rotary power means 20A would be directly translated into rotations of the well strata 7 in other embodiments it is contemplated that the rotary power means 20A might include a threaded collar sized and threaded for coordinated engagement of the threaded portion of the well string 7, to which the rotary power of the motor 20A would be directly applied in which would potentially result in the application of a direct raising or lowering of the well string 7 without necessarily rotation. However, insofar as it is explicitly contemplated that the system and method of the present invention will permit for incremental well string rotation in certain embodiments, those embodiments would either need to use the first approach whereby rotation of the power means 20A would actually directly rotate the well string 7 resulting in the ability to apply incremental rotation, or in the case of the threaded collar it would be necessary to include a locking mechanism which could lock the threaded collar to the well string and result in the ability for incremental rotation to be applied by the motor 20A. Both such approaches will be understood to those skilled in the art and are all contemplated with the necessary modifications to be within the scope of the present invention.

Figure 4A:
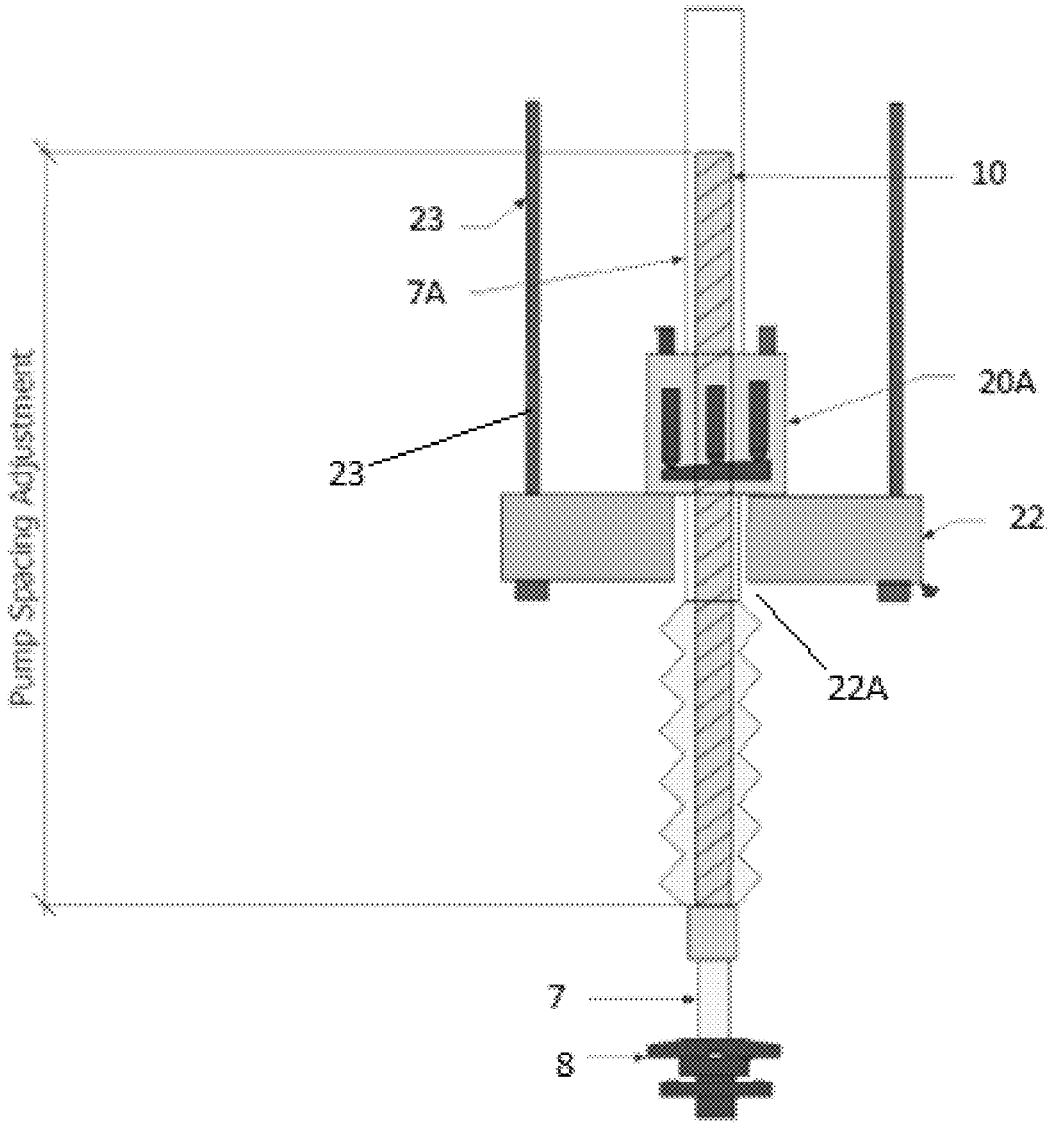
FIG. 4A is a detail drawing of the components of one embodiment of a well string positioner as otherwise outlined herein.

FIG. 4A shows a detailed schematic view of one embodiment of a well string positioner 20 within the scope of the present invention—where the rotary power means 20A is a hydraulic motor. Referring to that Figure, a carrier bar 22 and related yoke assembly can be seen which would be assembled between the well string 7 and the vertical reciprocating pump assembly 18, The rotary power means 20A is attached on top of the carrier bar 22 such that the carrier bar 22 will assist in the application of reciprocating vertical power from the yoke to the well string 7. The range of pump spacing adjustment defined by the threaded upper end of the well string 7 is also shown—the yoke 23 would be of sufficient length to allow for the entirety of the pump spacing adjustment and threaded portion of the well string 7 to move above the carrier bar 22 during operation of the pump jack without the need for stopping the application of vertical power and/or without the need to disassemble the well string. The pump spacing adjustment as shown in this Figure effectively defines the range of motion and the range of adjustment of the downhole well string length possible.

It is explicitly contemplated that the rotary power source of the well string positioner could be a bidirectional motor, mounted with the requisite hardware to apply rotational motion in either direction to the threaded top end of the well string 7.

The engagement of the threaded portion of the top end of the well string 7 and the well string positioner vertically retains the well string 7 and positioned in relation to the tubular 2, whereby the downhole well string length will be fixed and maintained except when altered by actuation of the well string positioner and the length of the well string will move up and down within the tubular 2 in conjunction with the reciprocal vertical movement.

Controller

Figure 5:
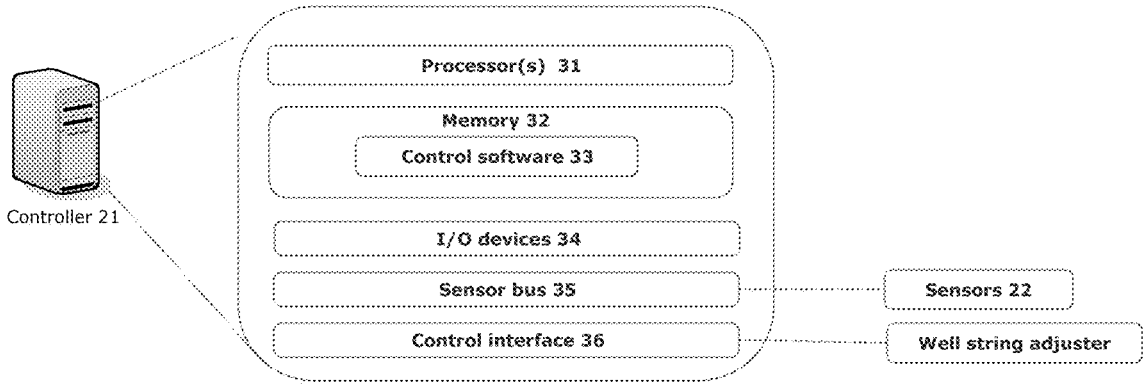
FIG. 5 is a block diagram of the components of one embodiment of a controller of the present invention.

Referring to FIG. 5 there is shown a block diagram demonstrating the components of one potential embodiment of the controller 21 of the present invention. The controller 21 might be a pre-existing computer or system controller at the oil well site, with the attendant software modifications, or might be a purpose-built hardware device. Many types of hardware and software could be used in this approach and all will be considered within the scope of the present invention. The controller 21 includes one or more processors 31 and memory 32. The memory on the controller 21 might include various types of processor instructions either for assistance in the execution of the method of the present invention or for other activities to be undertaken by the controller 21—control software 33 is shown. The memory 32 would also include any necessary software components to communicate with the well condition sensors 22.

The controller 21 shown in this figure also shows one or more input and output devices 34 by which an operator of the controller 21 could interact with and enter information for capture. In some implementations, the controller 21 might also include a clock, location sensor or the like. Also present in the controller 21 would be a sensor bus 35 by which the controller 21 could communicate with the sensors 22 for the capture of well condition sensor readings. The controller 21 would also include either a separate or combined communication interface 36 by which the controller 21 could communicate with and actuate the well string positioner.

As outlined some embodiments of the controller 21 might also include a network interface whereby the controller 21 could be accessed either locally or remotely via a local or wide area network to provide control inputs, monitor its performance and otherwise, and the addition of such additional components will be understood to be within the scope of the present invention. As well as outlined above, it is specifically contemplated that the hardware of the controller 21 could either be a software enabled configuration of a standard computer at the oil well site, or a purpose built or purpose programmed programmable logic controller or the like could be used as well. Any type of a combination of software and hardware which is capable of achieving the desired and needed steps of the method of the present invention outlined herein will be understood to be contemplated within the scope of the present invention from the perspective of the broadest enablement of the controller element.

Well Condition Sensor

Any number of different types of well condition sensors 22 could be used in the system of the present invention where it was desired to implement an automated well string adjustment methodology within an oil well tubular driven by a traditional vertical reciprocating power unit. Many different types of sensors will be understood to those with expertise in this area—any type of a sensor 22 which was capable of detecting, either from monitoring the above surface equipment or in a downhole fashion, the need to adjust the well string to optimize its performance or avoid equipment damage is understood to be contemplated within the scope of the present invention. As discussed and outlined, the at least one well condition sensor could be a downhole sensor, a sensor 22 connected to the aboveground equipment, or some combination thereof—any type of a sensor which could be monitored by the controller in accordance with the remainder of the present invention will be understood to be contemplated within the scope hereof.

As also described elsewhere herein, more than one well condition sensor 22 could be used if it was desired to detect either redundantly a single type of a well condition requiring a well string adjustment or alternatively if it was desired to monitor more than one parameter which might indicate the existence of a well string positioning condition and again any number of well condition sensors will be understood to be within the scope of the present invention.

The controller 21 of the present invention would be modified or would contain the necessary communications bus to sample readings from the at least one well condition sensor 22.

It is explicitly contemplated that at least one well condition sensor 22 for use in conjunction with the remainder of the system and method of the present invention could be a human interface operatively connected to the controller, whereby an operator could manually select a well string adjustment or indicate to the remainder of the system the existence of a string positioning condition requiring an adjustment downhole. It will be understood that any combination of sensors 22 could include at least one human interface device 22 along with one or more automated sensors 22 all of which could be connected to the controller 21 for individual or combined reading and operation in accordance with the remainder of the method of the present invention and any such type of a human interface device, including an analog or digital input, computer interface to a local or wide area network or the like are all contemplated within the scope of the present invention. It is explicitly contemplated that one type of a human interface device which could be used as a well condition sensor 22 would actually be a interface on a computer network by which an operator could remotely adjust the well string in the oil well—for example by way of a smart phone app, remote monitoring software application and the like—wherein a well string adjustment and the related existence of a condition could be communicated to the controller 21 remotely via the human interface 22 of a client device on a computer network operatively connected to the controller 21.

A remote control application such as this will be understood to be explicitly contemplated within the scope of human interface well condition sensors 22 which are contemplated within the scope of the present invention and that the existence of the string positioning condition could be indicated to the controller 21 via a remote human interface software input from an operator.

It will also be understood that the controller 21 might facilitate additional instrumentation or additional viewing or reporting of the values sensed from the at least one well condition sensor 22—while beyond the general or necessary scope of the present invention certain embodiments of the system outlined herein may include an ability for a user via a remote client device operatively connected via a wide area computer network to the controller 21 to read certain values therefrom in addition to allowing in certain cases for the selection of manual control inputs to adjust well string. It will be understood that such alterations are contemplated within the scope of the present invention as well.

It will be apparent to those of skill in the art that by routine modification the present invention can be optimized for use in a wide range of conditions and application. It will also be obvious to those of skill in the art that there are various ways and designs with which to produce the apparatus and methods of the present invention. The illustrated embodiments are therefore not intended to limit the scope of the invention, but to provide examples of the apparatus and method to enable those of skill in the art to appreciate the inventive concept.

Those skilled in the art will recognize that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A controller for use in automatic adjustment of downhole well string length of a subterranean oil well extraction apparatus, said apparatus comprising:

a) a well tubular extending downwards from a wellhead at the earth surface to a bottom of a well in a subterranean fluid-producing formation;

b) a well string of circular cross-section having a lower end and a top end and extending downward through a seal on the wellhead inside the well tubular to at least a position within the tubular within the fluid-producing formation, the length of a length string from below the wellhead seal to the lower end being the downhole well string length and a section of the well string extending downwards from the top end being threaded;

c) a downhole plunger-style pump located within the tubular at the lower end of the well string which will be actuated by vertical reciprocating movement of the well string to pump oil from the formation up the well tubular to the wellhead;

d) a rotary well string positioner connected to a vertical reciprocating power unit capable of applying vertical reciprocating movement of a desired stroke length to the well string, the rotary well string positioner comprising:

a. a carrier bar suspended from the vertical reciprocating power unit and having a collar with an internally threaded aperture positioned in alignment with an axis of the well string and having an internal thread pattern and diameter corresponding to an external thread pattern and diameter of the top end section of the well string, said collar for engaging and supporting said top end section of the well string and translating a weight of the well string to the carrier bar; and b. a bidirectional rotary power source engaging and capable of applying rotation to the top end of the well string, whereby upon actuation of said rotary power source the top end of the well string will move upwards or downwards through the collar, depending upon the direction of rotation thereof, translating into decreasing or increasing the downhole well string length; and a threaded weight-bearing engagement of the well string by the collar vertically retains the well string in position in relation to the tubular whereby the downhole well string length will be fixed and maintained except when altered by actuation of the rotary power source, and the length of the well string will move up and down within the tubular in conjunction with the vertical reciprocating movement;

e) at least one well condition sensor capable of determining an existence of a string positioning condition within the tubular;

said controller comprising an electronic controller capable of monitoring the at least one well condition sensor, and of actuating the rotary power source to modify the downhole well string length;

whereby during operation of the vertical reciprocating power unit, the controller will:

i. monitor the at least one well condition sensor to detect the existence of a string positioning condition within the tubular; and ii. upon detection of a string positioning condition within the tubular, actuate the rotary power source to modify the downhole well string length to eliminate the string positioning condition;

wherein the downhole well string length can be modified during operation of the vertical reciprocating power unit without the need to disassemble the well string, and a stroke length of the vertical reciprocating movement does not change when the downhole well string length is modified; and wherein the well string can be rotated along its axis within the tubular during operation of the vertical reciprocating power unit without any need to deactivate the vertical reciprocating power unit, and without detaching the well string from a remainder of the apparatus.

2. The controller of claim 1 wherein the controller will periodically actuate the rotary power source to incrementally rotate the well string during operation of the vertical reciprocating power unit.

3. The controller of claim 1 wherein the string positioning conditions sought to be detected within the tubular are selected from the following:

a. a travelling valve assembly of the pump not being optimally positioned, such that the downhole well string length needs to be increased or decreased; or b. a manual control input from operators wishing to manually adjust the downhole well string length.

4. The controller of claim 3 further comprising a human interface through which an operator can create a manual control input to trigger a string positioning condition.

5. A method of automatic adjustment of downhole well string length within a tubular of a subterranean oil well extraction apparatus, said apparatus comprising:

a) the tubular extending downwards from a wellhead at the earth surface to the bottom of a well in a subterranean fluid-producing formation;

b) a well string of circular cross-section having a lower end and a top end and extending downward through a seal on the wellhead inside the well tubular to at least a position within the tubular within the fluid-producing formation, a length of the well string from below the wellhead seal to the lower end being the downhole well string length and a section of the well string extending downwards from the top end being threaded; and c) a downhole plunger-style pump located within the tubular at the lower end of the well string which will be actuated by vertical reciprocating movement of the well string to pump oil from the formation up the well tubular to the wellhead;

d) a vertical reciprocating power unit capable of applying vertical reciprocating movement of a desired stroke length to the well string;

e) a rotary well string positioner connected to the reciprocating power unit comprising:

a. carrier bar suspended from the vertical reciprocating power unit and having a collar with an internally threaded aperture positioned in alignment with an axis of the well string and having an internal thread pattern and diameter corresponding to an external thread pattern and diameter of the top end section of the well string, said collar for engaging and supporting said top end section of the well string and translating a weight of the well string to the carrier bar; and b. a bidirectional rotary power source engaging and capable of applying rotation to the top end of the well string, whereby upon actuation of said rotary power source the top end of the well string will move upwards or downwards through the collar, depending upon the direction of rotation thereof, translating into decreasing or increasing the downhole well string length; and a threaded weight-bearing engagement of the well string by the collar vertically retains the well string in position in relation to the tubular whereby the downhole well string length will be fixed and maintained except when altered by actuation of the rotary power source, and the length of the well string will move up and down within the tubular in conjunction with the vertical reciprocating movement; and f) a controller capable of monitoring at least one well condition sensor to determine an existence of a string positioning condition within the tubular, and of actuating the rotary power source;

wherein the method comprises, during the operation of the vertical reciprocating power unit, using the controller to:

i. monitor the at least one well condition sensor to detect the existence of a string positioning condition within the tubular; and ii. upon detection of a string positioning condition within the tubular, actuate the well string positioner to modify the downhole well string length to eliminate the string positioning condition by applying desired rotational motion to the well string by actuation of the rotary power source;

whereby the well string positioner can be actuated and operated during an operation of the vertical reciprocating power unit without the need to disassemble the well string;

wherein a stroke length of the vertical reciprocating power unit does not change when the downhole well string length is modified; and wherein the well string can be rotated along its axis and the downhole well string length can be modified within the tubular during operation of the vertical reciprocating power unit without any need to deactivate the vertical reciprocating power unit, and without detaching the well string from a remainder of the apparatus.

6. The method of claim 5 wherein the rotary power means comprises a hydraulic or electric motor.

7. The method of claim 5 wherein the controller will periodically actuate the rotary power source to incrementally rotate the well string during operation of the vertical reciprocating power unit.

8. The method of claim 5 wherein the string positioning conditions sought to be detected within the tubular are selected from the following:

a. a travelling valve assembly of the pump not being optimally positioned, such that the downhole well string length needs to be increased or decreased; or b. a manual control input from operators wishing to manually adjust the downhole well string length.

9. The method of claim 5 wherein the vertical reciprocating power unit is a conventional oilfield pump jack.

10. A system for use in the automatic adjustment of downhole well string length within a tubular of a subterranean oil well extraction apparatus, said apparatus comprising:

a) the tubular extending downwards from a wellhead at the earth surface to the bottom of a well in a subterranean fluid-producing formation;

b) a well string of circular cross-section having a lower end and a top end and extending downward through a seal on the wellhead inside the well tubular to at least a position within the tubular within the fluid-producing formation, a length of the well string from below the wellhead seal to the lower end being the downhole well string length and a section of the well string extending downwards from the top end being threaded;

c) a downhole plunger-style pump located within the tubular at the lower end of the well string which will be actuated by vertical reciprocating movement of the well string to pump oil from the formation up the well tubular to the wellhead; and d) a vertical reciprocating power unit capable of applying vertical reciprocating movement of the desired stroke length for the pump to the well string;

said system comprising:

i. a rotary well string positioner connected to the reciprocating power unit and comprising:

a. a carrier bar suspended from the vertical reciprocating power unit and having a collar with an internally threaded aperture positioned in alignment with an axis of the well string and having an internal thread pattern and diameter corresponding to an external thread pattern and diameter of the top end section of the well string, said collar for engaging and supporting said top end section of the well string and translating a weight of the well string to the carrier bar; and b. a bidirectional rotary power source engaging and capable of applying rotation to the top end of the well string, whereby upon actuation of said rotary power source the top end of the well string will move upwards or downwards through the collar, depending upon the direction of rotation thereof, translating into decreasing or increasing the downhole well string length; and a threaded weight-bearing engagement of the well string by the collar vertically retains the well string in position in relation to the tubular whereby the downhole well string length will be fixed and maintained except when altered by actuation of the rotary power source, and the length of the well string will move up and down within the tubular in conjunction with the vertical reciprocating movement; and ii. a controller capable of monitoring at least one well condition sensor to determine an existence of a string positioning condition within the tubular, and of actuating the rotary power source;

whereby during operation of the vertical reciprocating power unit, the controller will monitor the at least one well condition sensor to detect the existence of a string positioning condition within the tubular; and upon detection of a string positioning condition within the tubular, actuate the rotary power source to modify the downhole well string length to eliminate the string positioning condition;

wherein the downhole well string length can be modified during operation of the vertical reciprocating power unit without the need to disassemble the well string, and a stroke length of the vertical reciprocating movement does not change when the downhole well string length is modified; and wherein the well string can be rotated along its axis within the tubular during operation of the vertical reciprocating power unit without any need to deactivate the vertical reciprocating power unit, and without detaching the well string from a remainder of the apparatus.

11. The system of claim 10 wherein the rotary power means comprises a hydraulic or electric motor.

12. The system of claim 10 wherein the controller will periodically actuate the rotary power source to incrementally rotate the well string during operation of the vertical reciprocating power unit.

13. The system of claim 10 wherein the string positioning conditions sought to be detected within the tubular are selected from the following:

a. a travelling valve assembly of the pump not being optimally positioned in the downhole plunger-style pump, such that the downhole well string length needs to be increased or decreased; or b. a manual control input from operators wishing to manually adjust the downhole well string length.

14. The system of claim 10 wherein the vertical reciprocating power unit is a conventional oilfield pump jack.

* * * * *